US005577474A

United States Patent [19]

Livshiz et al.

[11] Patent Number: 5,577,474

[45] Date of Patent: Nov. 26, 1996

[54] TORQUE ESTIMATION FOR ENGINE SPEED CONTROL

[75] Inventors: Mike Livshiz, Southfield; David J. Sanvido, Novi, both of Mich.

[73] Assignee: General Motors Corporation, Detroit, Mich.

[21] Appl. No.: 563,743

[22] Filed: Nov. 29, 1995

[51] Int. Cl.[6] ..... F02D 31/00

[52] U.S. Cl. ..... 123/352

[58] Field of Search ..... 123/352, 339.11, 123/339.21, 339.2, 436; 364/426.04

[56] References Cited

U.S. PATENT DOCUMENTS

| | | | |
|---|---|---|---|
| 4,638,778 | 1/1987 | Kamei et al. | 123/339.2 |
| 4,862,851 | 9/1989 | Washino et al. | 123/339.21 |
| 4,984,545 | 1/1991 | Kaneyasu et al. | 123/352 |
| 5,010,866 | 4/1991 | Ohata | 123/352 |
| 5,249,558 | 10/1993 | Imamura | 123/339.2 |
| 5,270,934 | 12/1993 | Kobayashi | 364/426.04 |
| 5,385,516 | 1/1995 | Grange et al. | 477/107 |
| 5,392,215 | 2/1995 | Morita | 364/426.04 |
| 5,421,302 | 6/1995 | Livshits et al. | 123/339.23 |
| 5,463,993 | 11/1995 | Livshiz et al. | 123/339.2 |
| 5,465,617 | 11/1995 | Dudek et al. | 73/118.2 |
| 5,495,835 | 3/1996 | Ueda | 123/339.11 |

*Primary Examiner*—Raymond A. Nelli
*Attorney, Agent, or Firm*—Michael J. Bridges

[57] ABSTRACT

Engine torque control as a function of a steady state and a transient torque control command to drive engine speed toward a target engine speed provides for a correction to the steady state torque control command to account for unmodelled effects of such slowly changing parameters as ambient temperature and pressure and engine coolant temperature, by determining a difference between an expected and an actual engine control parameter as function of the current engine operating level, translating such difference to an engine torque requirement deviation caused by unmodelled effects, and providing a torque correction therefor so that compensation may be provided in an appropriate manner for the unmodelled effects. The torque correction may further be stored as a function of the current value of the slowly changing parameters to develop a stored model which may be accessed, once developed, to provide the compensation with minimum on-line computation.

14 Claims, 3 Drawing Sheets

TORQUE ESTIMATION FOR ENGINE SPEED CONTROL

FIELD OF THE INVENTION

This invention relates to engine speed control and, more particularly, to estimation of engine output torque and engine control in response thereto.

BACKGROUND OF THE INVENTION

Automotive internal combustion engine speed control is generally known to include both steady state and transient compensation strategies. The steady state strategy provides for engine speed reference tracking under engine steady state operating conditions with minimum steady state error. The transient strategy provides for disturbance rejection and transient compensation to substantially maintain the reference engine speed when engine load is changing or when disturbances are incident on the system.

Typically, the steady state compensation strategy processes input signals indicating the engine operating level and, through stored calibration values, generates a steady state engine output torque requirement. A control command is periodically adjusted to provide for the engine output torque requirement. Commonly, the control command is directed to an engine intake air rate control actuator, such as a bypass air valve, to vary engine intake air rate to achieve the output torque requirement. While not as responsive a torque control parameter as spark timing variation, the intake air rate control is sufficiently responsive to provide adequate torque control under most steady state engine operating conditions.

The accuracy of the intake air rate command for the steady state compensation strategy is limited by the accuracy of the stored calibration information. Generally, the steady state torque requirement Tss can be determined as follows $$Tss=f(MAP,RPM,EST,A/F,AMB,TEMP,BARO)$$

in which MAP is engine intake manifold absolute pressure, RPM is engine speed, EST is spark timing advance, A/F is engine air/fuel ratio, AMB is ambient temperature, TEMP is engine coolant temperature, and BARO is barometric pressure. During a conventional calibration process, the parameters MAP, RPM, EST, and A/F can be varied without significant difficulty to provide a precise calibration of the resulting variation in Tss. However, the parameters AMB, TEMP and BARO are not easily controllably varied during a conventional calibration process and therefore are not accurately incorporated in the Tss calibration information, if at all. The result is an on-line compensation for engine speed error under both steady state and transient operating conditions caused by an inadequate calibration for changes in BARO, TEMP, and AMB. The on-line compensation typically includes controlling spark timing EST advance to compensate for such inadequate calibration. This reduces spark timing authority available to compensate for other transients and disturbances that may occur, which can reduce transient control performance. Further, any attempt at calibrating for change in TEMP, AMB, and BARO will be substantially inaccurate and will increase calibration time and difficulty, adding to automotive vehicle cost.

It would therefore be desirable to determine the effect of such slowly changing and difficult to calibrate parameters as BARO, AMB, and TEMP on the engine steady state torque requirement and to incorporate such learned information into the determination of the steady state torque requirement, to improve engine speed control reference tracking, to preserve ignition timing control authority, and to relieve a significant calibration burden.

SUMMARY OF THE INVENTION

The present invention provides a desirable engine speed controller which accurately determines engine steady state output torque requirement on-line with minimum calibration difficulty and including information on such slowly changing parameters as BARO, AMB, and TEMP, so that an accurate control command contemplating all parameters affecting engine steady state torque requirement may be determined and provided for proactively via position control of an engine intake air valve.

More specifically, when steady state conditions are present, such as indicated by a stable engine intake air rate or a stable engine intake manifold pressure, a deviation in a parameter away from a value expected under calibration conditions is determined. The deviation represents the level of additional compensation being applied in addition to a calibrated steady state compensation to minimize engine speed error. The additional compensation being applied under the steady state conditions is directed to unmodelled effects, such as due to variation in parameters not accounted for in a calibration model of steady state engine output torque requirement. The additional compensation may be provided by variation in spark timing, resulting in an unnecessary reduction in already limited spark timing authority. The change in the engine output torque requirement represented by the additional compensation may be derived knowing the sensitivity of engine output torque to deviation in the parameter. A compensating engine intake air control command may then be determined as a direct function of the change in the engine output torque requirement and may be applied as a correction to the intake air control command. Once the correction is applied, the spark timing compensation may be required is reduced, increasing spark timing authority for the more appropriate task of transient and disturbance rejection.

In accord with a further aspect of this invention, the learned change in the engine output torque requirement, representing calibrated model error at the current engine operating condition may be recorded for subsequent application at or near the current engine operating condition. Further, the current value of such slowly changing and otherwise unmodelled parameters as AMB, BARO, and TEMP may be sensed or estimated, and the learned change in the engine output torque requirement stored as a function thereof to build a model to supplement the calibration information. The model may be developed and adapted over a variety of engine operating conditions as varying AMB, BARO, and TEMP values are encountered and corresponding changes in the torque requirement determined in accord with an additional aspect of this invention. When such a model is substantially fully developed, the torque correction may be provided by applying such sensed or estimated values as AMB, TEMP, and BARO directly to the model to reference a torque requirement correction value to adjust the overall engine steady state output torque requirement value with a minimum of additional analysis or throughput burden, with minimum calibration difficulty, with minimum reliance of steady state torque correction through ignition timing variation, and with reduced engine speed reference tracking error.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
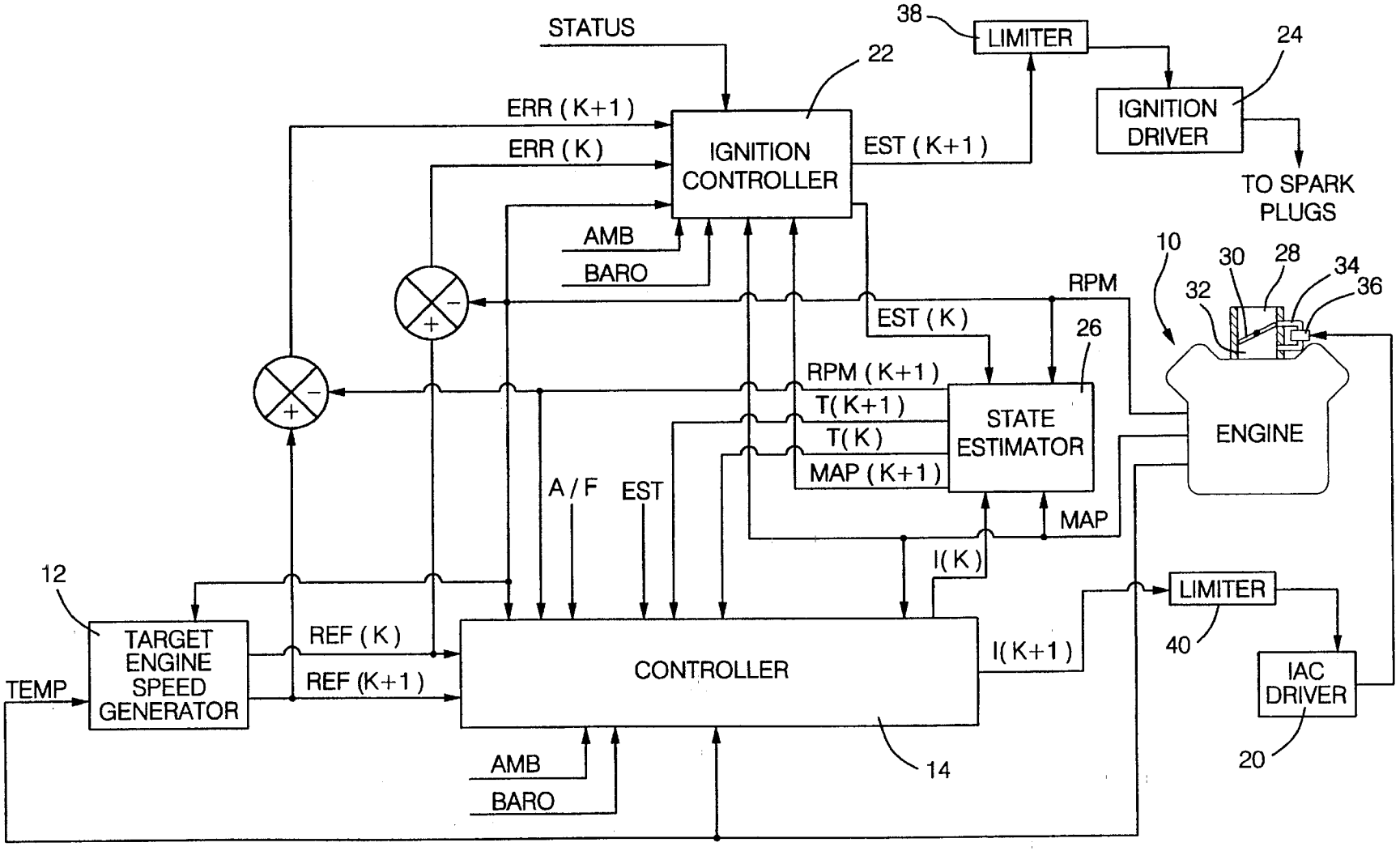
FIG. 1 is a general diagram of the engine and engine control hardware of the preferred embodiment of this invention.

Referring to FIG. 1, intake air is provided to internal combustion engine 10 via intake air path 28 in which is disposed an inlet air valve 30, which may be a conventional butterfly valve the degree of rotation of which restricts airflow from the intake air path 28 to an intake manifold 32. Engine intake airflow may additionally be provided substantially independent of the positioning of the inlet air valve through an air conduit 34 opening, on a first end, into the intake air path 28 upstream of the valve 30 and opening on a second end into the intake manifold 32 downstream of the valve 30. A precision valve 36, such as a solenoid valve is provided along the bypass conduit 34 between the first and second ends, for controlling the restrictiveness of the conduit to airflow therethrough. The valve 36 is controlled through a drive command I applied thereto from an IAC driver 20, which may be a simple conventional drive circuit for converting an digital valve position command value into a drive current level. The position command value is determined to provide for a precise airflow into the engine for fine engine output torque adjustment, for example to provide for smooth, stable engine idle speed control.

In an alternative embodiment in accord with this invention, the bypass conduit 34 and the idle air valve 36 may be eliminated, and precise control of engine inlet air may be provided through known electronic throttle control techniques, for example by directly controlling an actuator coupled to the inlet air valve 30 so as to precisely position the valve in the intake air path and thus provide a high resolution control of engine intake air, for example to meet the exacting requirements of engine idle air control. In such an alternative embodiment, an appropriate drive circuit, for example generally corresponding to the IAC driver 20 is provided to receive the digital position command and convert the command into an analog drive current signal applied to a suitable throttle actuator, such as a DC motor.

The absolute air pressure MAP in intake manifold 32 is sensed by a conventional pressure transducer disposed in the engine intake manifold 32 and provided as output signal MAP. Engine coolant temperature is sensed via a temperature sensor (not shown), such as a conventional thermocouple disposed in an engine coolant circulation path (not shown), and is communicated as output signal TEMP. The engine intake air is received in the intake manifold 32 and distributed to a plurality of engine cylinders. The intake air is mixed with a delivered fuel quantity, such as may be injected to the intake manifold, to the engine cylinders, or to intake passages upstream of the engine cylinders by one or more conventional fuel injectors to which is provided a pressurized supply of fuel. The air/fuel mixture is ignited in the engine cylinders driving pistons within the cylinders to rotate one or more engine output shafts including a crankshaft (not shown). The rate of rotation of the crankshaft may be transduced by a commercially-available transducer, such as a Hall effect or variable reluctance sensor, positioned to detect passage of teeth or notches circumferentially disposed about the crankshaft, into a periodic engine speed signal RPM. The signal RPM may be substantially sinusoidal, with a frequency representing the rate of passage of the teeth or notches by the transducer. The teeth or notches may be positioned about the circumference of the crankshaft and spaced relative to each other so that each time the periodic signal RPM crosses a predetermined voltage threshold, an engine cylinder event, such as a engine net output torque producing event, may be assumed to have occurred.

The control structure of FIG. 1 is provided for engine speed control, including ignition timing control and intake air control in accord with this embodiment. The spark timing provides a responsive engine output torque control for load disturbance rejection, for increased engine stability through engine output torque damping, and for a more accurate minimum spark advance for best torque command determination incorporating engine load information indicated by current and future predicted manifold absolute pressure.

The engine intake air control, such as through controlled positioning of bypass valve 36 provides for accurate engine speed control under both steady state and transient operating conditions by determining a comprehensive steady state engine output torque requirement and providing for such requirement through intake air control alone to minimize reliance on spark timing variation for steady state control compensation.

Specifically in FIG. 1, signals RPM and TEMP are provided to a target engine speed generator 12 which generates, in accord with a predetermined schedule stored in a memory device, a target engine speed REF(K), such as a desired engine idle speed for the present control cycle indicated by index K, and for a next consecutive control cycle REF(K+1), indicated by index K+1. The target engine speeds may be constant speeds, determined in accord with an appropriate engine operating level for idle, such as approximately 700 r.p.m., or may vary in accord with a predetermined schedule, such as an engine warm-up schedule, wherein the engine speed decreases with increasing engine coolant temperature TEMP.

The present target engine speed REF(K) and the predicted target engine speed for the next consecutive control cycle REF(K+1) are communicated as reference inputs to a controller 14 for processing input signals applied thereto representing a present and a predicted engine operating condition and for generating and outputting an engine intake air rate control command, such as command I for controlling bypass valve position, as described. The controller 14 is further detailed in FIG. 2, to be described.

The controller 14 outputs an engine intake air command such as a bypass valve position command I(K) for the current (Kth) cylinder event to a state estimator 26, to be described, and outputs a desired engine intake air command such as a bypass valve position command I(K+1) for the next (K+1th) cylinder event to a limiter 40, which may be implemented in circuitry or through a control process to provide an upper limit of the magnitude of the idle air command, for example, so the command does not exceed any hardware or bandwidth constraints. The limited command I(k+1) is then applied to IAC driver 20, such as a conventional drive circuit for generating a drive current at a level substantially corresponding to the magnitude of the command I(k+1), and for outputting the drive current to the IAC actuator 36 (FIG. 1).

The state estimator 26 of FIG. 1 receives engine parameter information, and provides a prediction of engine states used in accord with this invention. Input information to the state estimator 26 includes signals RPM and MAP, a present idle air command I(K) from controller 14, and present spark timing command EST(K) generated by ignition controller 22, as will be further described. Such input information is used to predict engine speed for the next cylinder event RPM(K+1), engine torque for the current cylinder event T(k) and for the next cylinder event T(K+1), and manifold pressure is predicted for the next cylinder event MAP(K+1). Such prediction may be carried out using any conventional parameter prediction means. Preferably however, the engine speed and torque prediction techniques described in U.S. Pat. No. 5,421,302, assigned to the assignee of this application, and hereby incorporated herein by reference are to be applied as the portion of the state estimator 26 used to predict RPM(K+1), T(K+1), and T(K). Furthermore, the prediction approach described in the U.S. Pat. No. 5,094,213, assigned to the assignee of this invention, is preferably applied as the portion of the state estimator 26 used to predict MAP(K+1).

Current engine speed error ERR(K) is determined as a difference between the reference engine speed REF(k) and a current sample RPM(K) of the engine speed signal RPM. Predicted engine speed error is determined as a difference between the reference future engine speed REF(K+1) and the predicted engine speed for the next cylinder event RPM(K+1). The error signals ERR(K) and ERR(K+1) are applied to the ignition controller 22. Additionally, signal AMB representing a measured ambient automotive vehicle temperature, such as provided by a conventional temperature sensor positioned on the vehicle to detect ambient air temperature is applied to the ignition controller 22. Still further, a signal BARO, representing ambient barometric pressure, for example as may be provided by a conventional barometric pressure transducer or as may be provided by sampling the signal MAP under engine operating conditions in which the pressure drop across the valve 30 is minimal, is provided to the ignition controller 22. Still further, a status input value stored in controller memory and including a number of flags indicating the status of certain accessory load requests is provided to the ignition controller 22. Each of the flags of the status input value may correspond to one or more accessory loads, indicating whether a request is pending for the corresponding load to be applied. The accessory loads may include air conditioner clutch, automatic transmission shift, and other loads which can be rapidly applied and removed from the engine, wherein such application and removal causes a sudden and significant change in engine output torque margin, affecting engine speed stability, as is generally understood in the art. For example, if the flag of the status input value is set, a request for application of the corresponding accessory load is pending and if the flag is clear, the load may, if necessary, be removed.

The ignition controller 22 provides for engine speed tracking and load rejection through a determination of a minimum best torque ignition timing command responsive to engine speed and to manifold absolute pressure MAP. MAP information provides for an improved modeling of engine load, so that a more accurate MBT calculation may be provided. The ignition controller further provides for determination and application of a spark timing offset as a function of such operating conditions as accessory load status, barometric pressure and ambient temperature. Such provides for compensation of conditions that are difficult to incorporate into spark timing calibration and further replaces the feedforward control of idle air and spark timing provided, for example, in the ignition timing approach of the incorporated reference, significantly reducing calibration complexity. Still further, the ignition controller 22 provides predictive spark control with engine speed feedback information and control gains determined as a function of predicted RPM and MAP. The ignition controller 22 takes the form of that described in the above-identified copending U.S. Patent application and alternatively, may take the form of the ignition controller 22 of the U.S. Patent incorporated herein by reference. The ignition controller 22 combines the determined MBT and predictive spark control information with the timing offset to yield an ignition timing command for a next consecutive engine ignition event EST(k+1) which is output to a limiter 38, such as may be provided as conventional command limiting circuitry for limiting the command EST(K+1) to a predetermined command range, so as to provide that the command does not exceed any hardware or bandwidth constraints. The limited command is then passed as a spark advance command for the next cylinder event EST(K+1) to ignition driver 24, which may generate ignition commands for the active one(s) of the engine spark plugs (not shown) and deliver such commands at the engine operating angle dictated by the top dead center position of the next cylinder to have a combustion event advanced in accord with the command EST(k+1).

Figure 2:
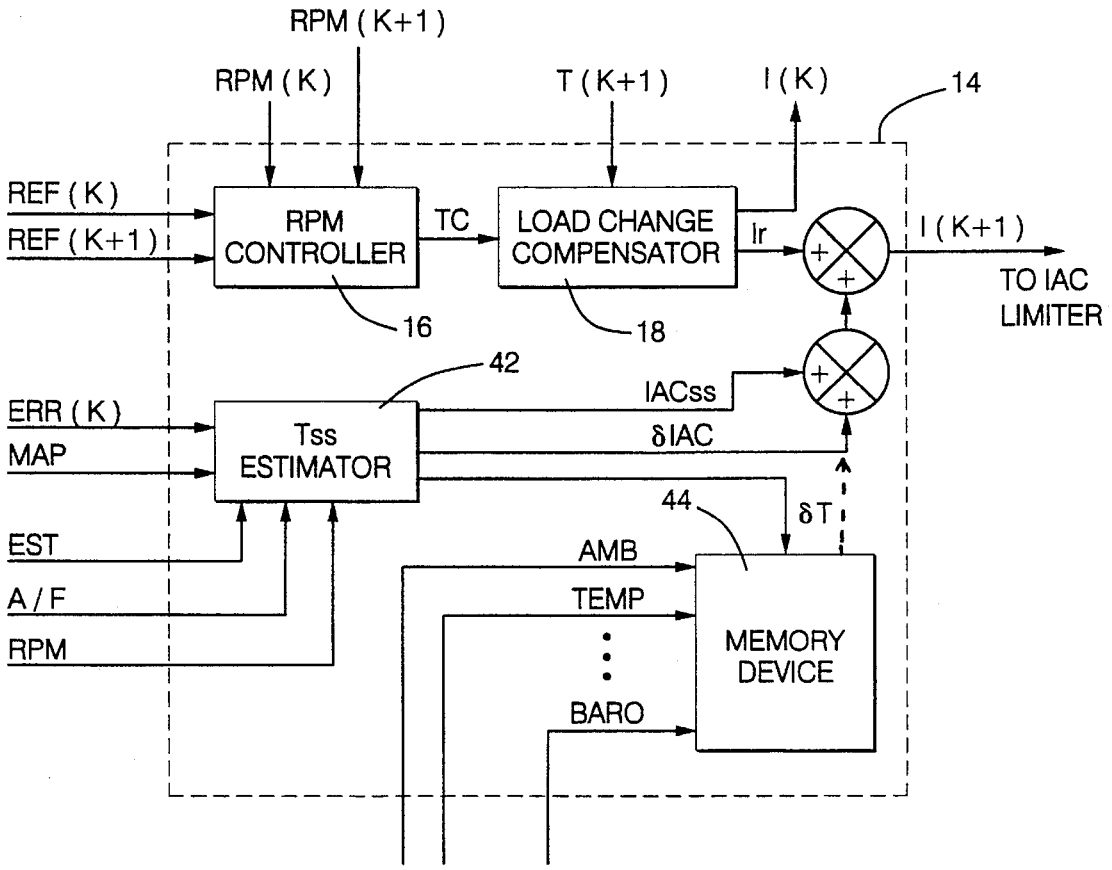
FIG. 2 diagrams the structure of the controller of FIG. 1 for generating an engine intake air command.

Referring to FIG. 2, controller 14 provides for generation of a bypass valve command I for controlling bypass air to the engine to provide an engine output torque driving engine speed toward a target speed REF(K). Controller 14 is provided corresponding to the nested loop structure described in the incorporated patent, wherein an outside loop is provided to compensate for rotational dynamic effects and for general disturbances incident on the engine speed control system of this embodiment. The outside loop through RPM controller 16 receives input signals RPM(K), RPM(K+1), REF(K) and REF(K+1) and generates a desired torque command TC to minimize a difference between the RPM(k) and REF(k) and to minimize a difference between RPM(k+1) and REF(k+1), as described in the incorporated reference. The desired torque command TC is generated through application of conventional control techniques, such as classical proportional-plus-integral-plus-derivative control techniques applied to the speed differences.

The compensating torque command TC is provided to an inner torque control loop nested within the described outside control loop providing for both steady state engine speed control and for load change compensation. A compensator 18 within this loop is provided to compensate for fuel delivery and combustion delays in the system, generating a command Ir as a function of TC and of T(K+1), for example through a conventional control strategy, such as a conventional proportional-plus-derivative control strategy. Further, a current intake air valve command I(K) is output by torque controller 18 for use by the state estimator 26 of FIG. 1, in the manner described in the incorporated patent.

To provide for minimum steady state engine output torque control error, controller 14 further includes steady state torque Tss estimator 42 for generating a base steady state control command Iss in accord with calibration information and a correction command δIAC to correct the base steady state control command for change in torque requirements not modeled in calibration information in accord with this invention. The base command Iss may be referenced from stored calibration information describing the engine intake air rate under steady state idle operating conditions needed to maintain a stable, accurate engine speed control. The calibration information may not, without undue difficulty, contain information on the change in engine intake air rate as a function of change in such parameters as ambient temperature, engine coolant temperature, and barometric pressure, which only gradually change and therefore are difficult to incorporate into the stored calibration information. Accordingly, correction for such parameter changes is provided in accord with this invention through the command δIAC which is added to Iss and Ir to form I(K+1). Otherwise, correction for variation in such slowly changing parameters not modeled in the stored calibration information may be provided—even under steady state conditions—through responsive spark timing adjustment, consuming a portion of spark timing authority that should be reserved for more rapidly changing conditions. The availability of the accurate, responsive spark timing control will thereby be reduced, potentially leading to a less responsive, less accurate engine speed control.

Change in engine steady state torque δT determined by Tss estimator 42 to be caused by variation in such slowly changing parameters is output to a memory device, such as a conventional non-volatile memory device 44, together with information on the current level of such slowly changing parameters as BARO, AMB, and TEMP. As will be described, this information is applied to adapt and store in the memory device 44 a function describing the relationship between such slowly changing parameters as AMB, TEMP, and BARO and a change in steady state engine output torque, which may be used to correct the δIAC command or to supplant the process of determining δIAC and δT by simply looking up the change in engine output torque as a function of current values of TEMP, BARO, and AMB, as will be described.

Figure 3A:
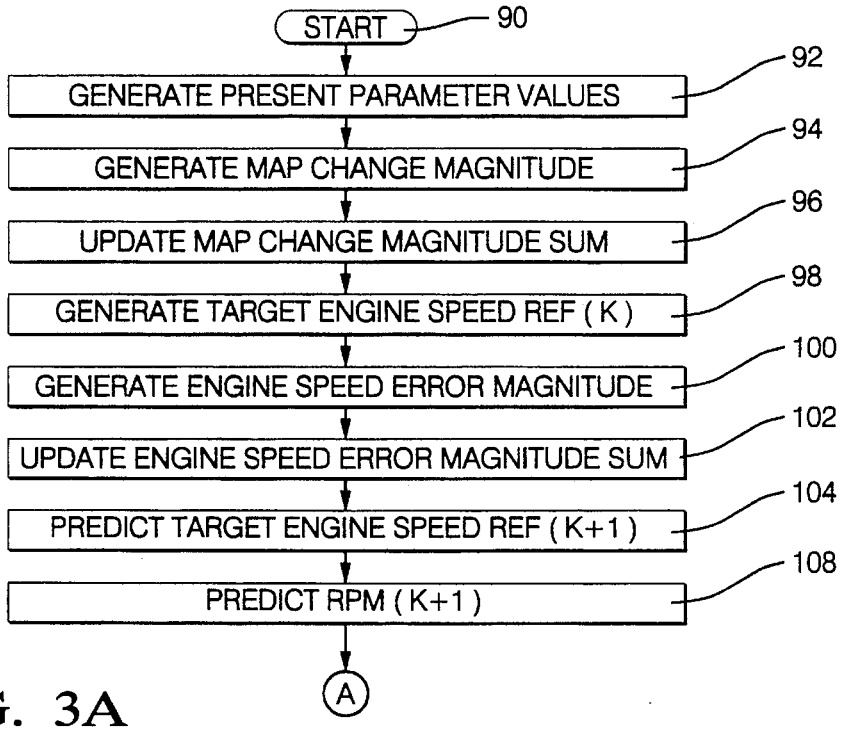
FIGS. 3A and 3B are flow diagrams illustrating a flow of control operations for generating the engine intake air command for controlling engine speed in accord with the controller structure of FIG. 2 and using the hardware of FIG. 1.
Figure 3B:
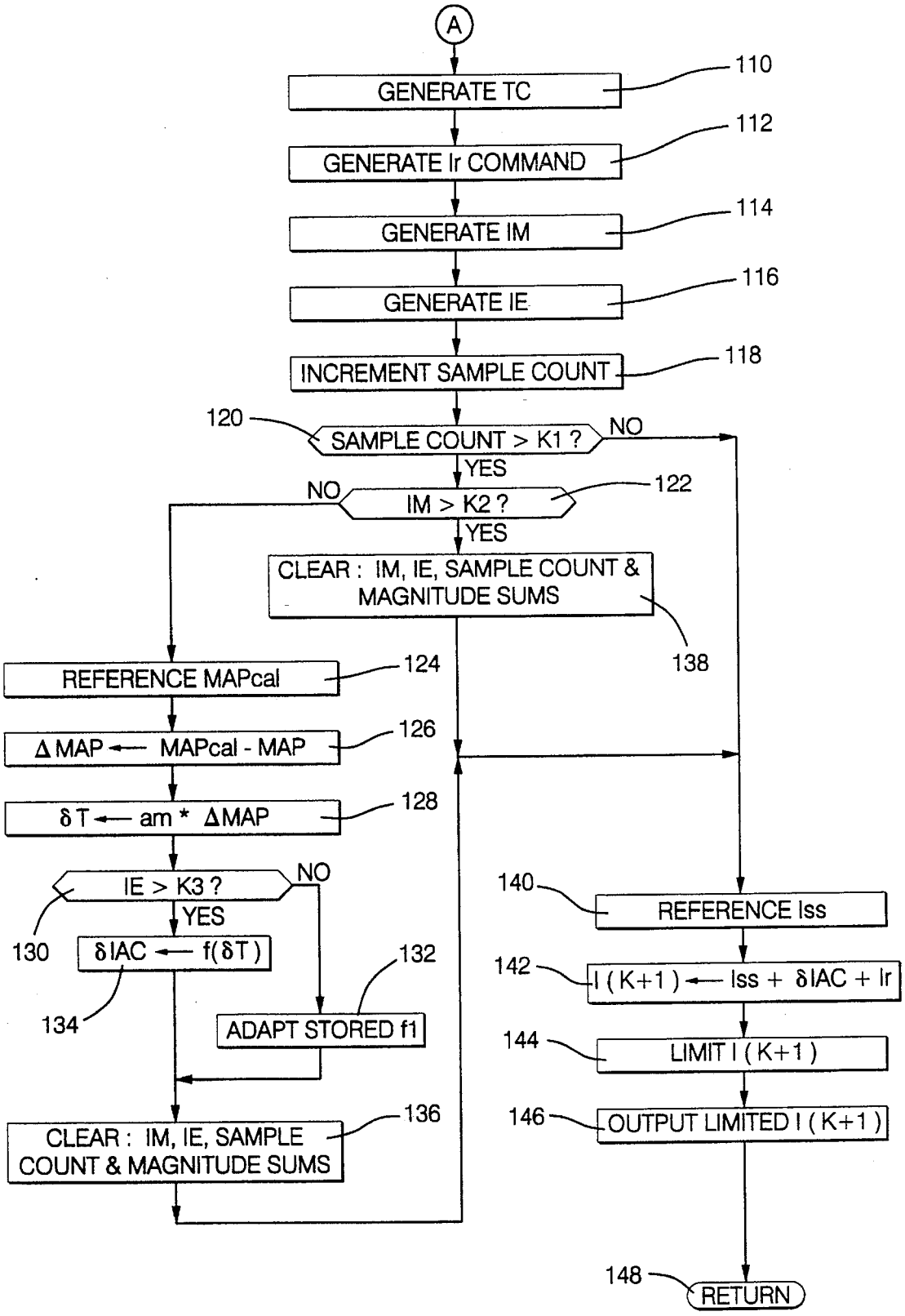

The series of operations for carrying out the control functions described generally in the FIGS. 1 and 2 are illustrated in a step by step manner in FIG. 3. The operations of this embodiment for providing spark timing control are as detailed in the copending U.S. Patent application incorporated herein. The operations of the routine of FIGS. 3A and 3B are executed by the controller 14 following each engine cylinder event as detected by a voltage reference crossing of signal RPM, as described. Upon the reference voltage crossing, a controller interrupt may be generated, wherein the controller 14 suspends its normal operations and executes the operations of FIGS. 3*a* and 3B, starting at a step 90 and proceeding to generate present parameter values at a next step 92. The present parameter values include present values of the parameters corresponding to signals BARO, AMB, TEMP, MAP, RPM, A/F, and EST(K).

A MAP change magnitude is next generated at a step 94 as an absolute value of a difference between the current MAP value as determined at the step 92 and a most recent prior MAP value. The generated change magnitude is next added to a sum of such magnitudes at a next step 96. A target engine reference speed REF(K) for the current or "Kth" engine cylinder event is next generated at a step 98 by the generator 12 of FIG. 1, as described, such as by referencing a reference engine speed from a conventional lookup table stored in non-volatile controller memory as a function of engine coolant temperature TEMP. As the engine coolant temperature increases, the reference speed may decrease from a maximum speed of 1200 r.p.m., to about 700 r.p.m. for a fully warmed-up engine. The relationship between engine coolant temperature and reference engine speed may be determined for an engine application through a conventional calibration process, and the relationship stored in the form of a lookup table. An engine speed error magnitude is next generated at a step 100 as an absolute value of a difference between REF(K) and RPM. The speed error magnitude is then added to a sum of such magnitudes at a next step 102.

A target reference speed REF(K+1) is next predicted at a step 104 as the desired engine speed for the next ("K+1th") consecutive engine cylinder event. REF(K+1) may be generated in the manner described for REF(K), for example by referencing REF(K+1) from a stored lookup table as a function of engine coolant temperature. A prediction of manifold absolute pressure at a next subsequent engine cylinder event, designated MAP(K+1) is next provided at a step 108, for example using the state prediction approach of U.S. Pat. No. 5,094,213, assigned to the assignee of this application, applied to manifold pressure prediction.

The routine of FIGS. 3A and 3B moves next to predict engine speed RPM(K+1) at the next cylinder event at a step 108. Such prediction is made in this embodiment through application of the prediction techniques detailed in U.S. Pat. No. 5,421,302, assigned to the assignee of this application. controlling bypass valve position, to be described. The torque command TC described as generated by RPM controller 16 of FIG. 2 is next generated at a step 110, for example as a function of engine speed error as further detailed in the incorporated patent, element 14 of FIG. 1. An intake air command Irl to provide for load change compensation is next generated by the compensator 18 of FIG. 2 at a step 112, for example as a function of TC and T(K+1) as described in FIG. 2. Irl compensates for transient conditions to reject such conditions to provide for robust engine speed control.

A value IM representing the quotient of the MAP change magnitude sum divided by SAMPLE COUNT is next generated at a step 114 indicating generally an average MAP over SAMPLE COUNT consecutive MAP samples. A value IE representing the quotient of the engine speed error magnitude sum divided by SAMPLE COUNT is next generated at a step 116 indicating generally an average engine speed error over SAMPLE COUNT consecutive engine speed error determinations. SAMPLE COUNT is next incremented at a step 118, and is compared to a calibrated constant, set to 64 in this embodiment at a next step 120. If SAMPLE COUNT exceeds K1, a sufficient amount of engine speed error and MAP change information has been accumulated to accurately characterize the current engine operating condition by proceeding to a next step 122 to compare IM to a calibration constant K2, which may be calibrated to about two kPa in this embodiment. If IM exceeds K2, then MAP has been changing by a sufficient magnitude over the SAMPLE COUNT number of samples to indicate a steady state condition is not currently present, and the steady state compensation operations of the routine of FIGS. 3A and 3B are avoided by proceeding to a next step 138 to clear IM, IE, SAMPLE COUNT and the magnitude sums generated at the steps 96 and 102, to prepare for the next K1 samples to be analyzed. The steps 140–148 are next executed to generated base engine intake air command information, to be described.

Returning to step 122, if IM is less than K2, a steady state condition is present, and steady state compensation operations of steps 124–136 are next carried out. Specifically, a stored calibration value MAPcal is referenced at a step 124. MAPcal is the manifold absolute pressure that was established during a conventional calibration process as corresponding to current values of EST(K) and MAP, as were determined at the step 92. The calibration process provides for estimation of a steady state engine output torque requirement, for example represented by an engine intake air command Iss under varying engine operating conditions indicated by varying MAP, RPM, EST, and air/fuel ratio. The calibration information in this embodiment is stored as a function of RPM and EST values. A MAP value and an Iss value are stored for each engine operating condition indicated by a single RPM value and a single EST value. It should be noted that air/fuel ratio is assumed to be substantially constant during such calibration process.

Returning to FIG. 3B, a MAP value, labeled MAPcal, is referenced at a step 124 from the calibration tables as a function of current RPM and EST. The Iss command value will likewise be referenced at a step 140, to be described, as the desired engine inlet air rate for the steady state condition represented by RPM and EST. The calibration process does not account for the effect on the steady state engine output torque requirement for stable engine speed control of such slowly changing parameters as BARO, AMB, and TEMP, which are typically difficult to accurately incorporate into the calibration of Iss. Accordingly, as such parameters change from calibration levels, the steady state engine output torque requirement can change significantly. This change can appear as a change in MAP away from the MAPcal corresponding to current RPM and EST. This change in MAP, labeled ΔMAP, is calculated at a next step 126 as a difference between MAPcal and the current MAP value determined at the step 92. A torque correction value δT is next calculated at a step 128 as a product of ΔMAP and a calibrated MAP to torque sensitivity factor am, established as the change in engine output torque for a change in MAP, under fixed RPM, EST, and A/F and while steady state conditions are present. The value δT is the change in engine output torque needed to account for change in parameters not accounted for in the described calibration process, such as change in BARO, AMB, and TEMP. Under steady state conditions, deviation in MAP away from MAPcal for a given fixed RPM and EST indicates that engine output torque is at a level not contemplated in the calibration process. Such torque variation is caused by unmodelled effects, such as variation in the describe slowly changing parameters.

After determining the torque correction value δT, IE is compared, at a next step 130, to a calibrated threshold engine speed K3, which is set to about five r.p.m. in this embodiment. If IE exceeds K3, steady state torque correction is needed as engine speed error, represented by IE is in excess of the tolerance K3 established to provide for stable control of engine speed. If correction is determined be needed, a change in engine intake air rate is determined at a next step 134, represented by δIAC which is a change in position of valve 36 of FIG. 1. δIAC is a direct function of δT, as change in engine intake air rate caused by a change in valve 36 position will result in a direct change in engine output torque, as is generally recognized in the art. The functional relationship between δIac and δT may be measured in a calibration process by determining the effect on engine output torque for change in valve position under a variety of engine operating conditions.

Returning to step 130, if correction is determined to not be required, a function f1, stored in the memory device 44 (FIG. 2) is adapted at a next step 132. The function is established to describe the relationship between BARO, TEMP, and AMB and δT. The function may be adapted by storing the current δT value in the memory device 44 (FIG. 2) as a function the current values of BARO, TEMP, and AMB. For example, a piecewise linear model of the function f1 may be stored in the form of a conventional lookup table by storing a point in the model defined by current δT, BARO, TEMP, and AMB. So that old model values are not preempted by new model values, a relatively gradual adaptation to new model breakpoints may be made by averaging, interpolating, or defining a predetermined functional relationship between old model breakpoint values and newer ones, for example through the use of conventional multiple regression techniques.

The results of such adaptive processes of step 132 are stored in the memory device 44 (FIG. 2) for use in the current routine or in routines of alternative embodiments. For example, following a determination of a δT value at the step 128, the current AMB, TEMP, and BARO values may be applied to the function f1 and a corresponding δT value referenced from the function. The referenced and the calculated δT values may then be resolved against each other so that the engine controls may benefit from information on the needed steady state torque correction learned in prior control iterations. Alternatively, it may be determined that a reasonably accurate function f1 is developed and stored in the memory device 44 through the operations of step 132. In such case, the operations of step 128 may be no longer executed and a δT value may be referenced directly from f1 as a function of AMB, BARO, and TEMP, saving processing time.

After adapting the stored function f1 at the step 132, or following the step 134, the stored values of IM, IE, SAMPLE COUNT, and the two magnitude sums are cleared at a next step 136 to prepare for the next series of stored MAP and RPM values. The Iss value corresponding to current RPM and EST(K) is next referenced from the stored calibration lookup tables at a next step 140. The overall air command I(K+1) is next determined as a sum of Iss, δIAC, and Ir at a step 142. It should be pointed out that any prior δIAC value reflecting correction for AMB, BARO, and TEMP variations may be used to correct the steady state command Iss when no update to such information is provided through the step 134. The intake air command I(K+1) provided to the bypass valve in this embodiment is next limited by limiter 40 of FIG. 1 at a step 144, so that the bypass valve 36 is operated in its linear range of operation, as is generally understood in the art. The limited I(K+1) command is next output at a step 146 to the IAC driver 20 of FIG. 1, so that adjustment of the engine bypass valve restrictiveness may be provided to drive engine output torque in direction to minimize engine speed error, as described. A next step 148 is then executed marking the completion of the engine intake air control operations of FIGS. 3A and 3B. At such step, any conventional control, diagnostic, or maintenance operations required to be executed during the current cylinder event interrupt may now be carried out, such as standard engine fueling control and diagnostic operations. After completing such additional operations, a resumption of any suspended controller operations may be provided.

The preferred embodiment for the purpose of explaining this invention is not to be taken as limiting or restricting this invention since many modifications may be made through the exercise of ordinary skill in the art without departing from the scope of the invention.

The embodiments of the invention in which a property or privilege is claimed are described as follows:

1. An engine speed control method for controlling engine output torque in accord with an engine torque requirement determined as the torque required to drive engine speed toward a target engine speed, comprising the steps of:

storing a predetermined schedule of estimated steady state torque requirement values as a function of a predetermined engine operating condition;

determining the current engine operating condition;

referencing, from the stored schedule, a current estimated steady state torque requirement as a function of the current engine operating condition;

estimating steady state torque requirement error;

adjusting the current steady state torque requirement in direction to minimize the estimated steady state torque requirement error; and controlling engine output torque in accord with the adjusted current steady state torque requirement.

2. The method of claim 1, wherein the estimating step further comprises the steps of:

providing a schedule of expected values of a predetermined engine operating parameter as a function of engine operating level;

determining the current engine operating level;

referencing the current expected value of the predetermined engine operating parameter from the provided schedule as a function of the current engine operating level;

sampling the current value of the predetermined engine operating parameter;

calculating a parameter deviation as a difference between the current expected value and the sampled current value; and estimating steady state torque requirement error as a predetermined function of the calculated parameter deviation.

3. The method of claim 2, further comprising the step of:

calibrating a sensitivity factor representing the sensitivity of engine output torque to a deviation in the predetermined engine operating parameter away from an expected parameter value; and wherein the predetermined function of the calculated parameter deviation is the product of the calculated parameter deviation and the calibrated sensitivity factor.

4. The method of claim 2, further comprising the steps of:

sensing a predetermined steady state engine operating condition;

and wherein the sampling step samples the current value of the predetermined engine operating parameter when the predetermined steady state engine operating condition is sensed.

5. The method of claim 2, further comprising the steps of:

developing a stored steady state torque requirement error model by storing the estimated steady state torque requirement error as a function of the sampled current value; and wherein, upon developing the stored steady state torque error model, the step of estimating steady state torque requirement error estimates the steady state torque requirement error by (i) sensing a present value of the at least one engine operating parameter, and (ii) referencing the stored steady state torque requirement error as a function of the sensed present value.

6. The method of claim 5, wherein the at least one engine operating parameter includes ambient temperature and ambient pressure.

7. The method of claim 5, wherein the at least one engine operating parameter includes engine coolant temperature.

8. The method of claim 1, further comprising the step of:

sampling present values of a predetermined set of engine parameter signals;

and wherein the step of determining the current engine operating condition determines the current engine operating condition as a function of the sampled present values.

9. An engine speed control method for generating a control command including a steady state torque control command component and a transient torque control command component, the control command applied to an engine output torque control actuator to drive engine speed toward a desired engine speed, comprising the steps of:

providing a predetermined schedule of steady state torque control commands representing the torque required for steady state engine speed control, the schedule provided as a function of engine operating level;

estimating the current engine operating level;

referencing, from the provided schedule, the steady state torque control command as a function of the current engine operating level;

estimating steady state torque control command error;

determining a command adjustment as a function of the estimated steady state torque control command error;

generating the control command as a function of the referenced steady state torque control command and the command adjustment; and applying the control command to the torque control actuator to control engine output torque to drive engine speed toward the desired engine speed.

10. The method of claim 9, wherein the estimating step further comprises the steps of:

providing a schedule of expected values of a predetermined engine parameter as a function of engine operating level;

referencing, from the provided schedule, the expected value corresponding to the current engine operating level;

sensing a predetermined steady state engine operating condition;

determining the current actual value of the predetermined engine parameter when the steady state engine operating condition is sensed;

calculating a difference between the expected value and the determined current actual value of the predetermined engine parameter; and estimating the steady state torque control command error as a predetermined function of the difference.

11. The method of claim 10, further comprising the step of:

providing a predetermined torque sensitivity factor as the sensitivity of engine output torque to the magnitude of the difference between the expected value of the predetermined engine parameter and the current actual value of the predetermined engine parameter; and wherein the predetermined function of the difference is the product of the torque sensitivity factor and the difference.

12. The method of claim 9, further comprising the steps of:

determining current values of a predetermined set of slowly changing engine parameters; and adapting a stored model of the estimated steady state torque control command error as a function of the determined current values and of the estimated steady state torque control command error;

and wherein the estimating step estimates the steady state torque control command error, by (a) sampling a value of the predetermined set of slowly changing engine parameters, and (b) referencing from the stored model a steady state torque control command error as a function of the sampled values.

13. The method of claim 12, wherein the predetermined set of slowly changing engine parameters includes ambient temperature, ambient pressure, and engine coolant temperature.

14. The method of claim 8, wherein the engine torque control actuator is an engine intake air valve.

* * * * *